US005433437A

United States Patent [19]

Dudley

[11] Patent Number: 5,433,437

[45] Date of Patent: Jul. 18, 1995

[54] FOOT MOUNTED SOUNDING SOCCER TRAINING DEVICE

[76] Inventor: Peter B. Dudley, 16359 Shady View La., Los Gatos, Calif. 95032

[21] Appl. No.: 270,047

[22] Filed: Jul. 1, 1994

[51] Int. Cl.[6] ..... A43B 23/00

[52] U.S. Cl. ..... 273/55 B; 36/139

[58] Field of Search ..... 273/29 A, 184 R, 55 R, 273/55 B, 65 R, 58 E, 148 R; 2/245, 246; 36/114, 136, 139

[56] References Cited

U.S. PATENT DOCUMENTS

| | | | |
|---|---|---|---|
| 847,240 | 3/1907 | Chamberlain | 36/139 |
| 2,195,522 | 4/1988 | Boot | 36/139 |
| 3,501,144 | 2/1987 | Schmidt | 36/139 |
| 4,711,043 | 12/1987 | Johnson et al. | 36/139 |
| 4,766,682 | 8/1988 | Malloy, III | 36/132 |

*Primary Examiner*—Vincent Millin
*Assistant Examiner*—William M. Pierce

[57] ABSTRACT

A soccer ball kick-training device for teaching the optimum foot position for kicking soccer balls. The device attaches to the top of the soccer player's shoe and provides a visual aid for locating the best striking area on the foot. It further provides an acoustic signal when the kick is properly done.

2 Claims, 4 Drawing Sheets

FOOT MOUNTED SOUNDING SOCCER TRAINING DEVICE

BACKGROUND-FIELD OF INVENTION

This invention relates generally to sporting equipment, particularly to an improved training device for soccer ball kicking.

BACKGROUND-DESCRIPTION OF PRIOR ART

New, young, aspiring soccer players generally have a problem properly kicking the soccer ball. The new, young players invariably kick the ball with the toe of their shoes. But the toe is a relatively small area with which to centrally strike the ball. The results are inaccurately kicked balls. The toe is also the least solid part of the foot. Kicking with the toe does not deliver a very powerfully kicked ball. In contrast, the best part of the foot to kick for power and accuracy is the top of the foot, "on the laces". After the new young player's have been instructed on this "shoelace kick", they have difficulty performing it. First, they often do not grasp exactly from where on their foot they are supposed to be kicking the ball. Second, they are not able to tell which part of the foot actually strikes the ball, while performing a normal speed kick. This lack of accurate feedback is the most significant obstacle to learning the proper soccer kicking technique for the young soccer novice. Additionally the new player needs to learn the most accurate pass, the "push" pass. This pass is performed by kicking the ball with the inside edge of the foot. And finally, the new player should learn the deceptive "outside foot" pass. This pass utilizes the outside of the instep.

Many soccer kick training devices have been invented. The vast majority do not address the problem of teaching the proper method of kicking the soccer ball. And no other device addressed all three soccer kicks the "on the laces", "push" pass and "outside foot" pass. Their concern is usually limited to means of restricting the travel of the soccer ball. Some involve tethering the ball to the player, in a manner generally represented by U.S. Pat. No. 5,083,797 Vartija et al. (1992). Most of the others, anchor the ball in some manner. For example, U.S. Pat. No. 5,037,113 Sowards (1991) connects the ball to a pedestal by means of a coil spring. With the tethering and anchoring type of devices, the player can kick the ball often, but without the knowledge that he or she is practicing the kick properly.

A soccer training device that addresses teaching the "top of the laces" kick is set forth in U.S. Pat. No. 4,865,330 D'Amico (1989). This patent describes a device that attempts to teach the novice to kick by guiding and channeling their kicking foot down a shoot. If the player is successful in getting his or her foot down the shoot, he or she will be learning the proper method of performing the "shoelace kick". But if the player misses, he or she might kick one of the edges of the shoot. The device is described as a ". . . high strength, impact-resistant structure." Kicking such a device could be painful. It is recommended that, after practicing standing still, the player takes a few running steps forward before kicking the ball being held in the structure. Running and kicking would lead to more inaccurate kicks and more kicking of the structure, In fact, D'Amico even states, "Without focus, instead of kicking the ball, the player is more likely to kick the kick-trainer". A further disadvantage to this device is that it can only be used in a static kicking drill. It would not be practical to use in practice games, or in game situation drills. Finally, it is assembled from several relatively large parts, that give it a relative high economic cost for its limited functionality.

A smaller device for teaching the "top of the laces" kick is U.S. Pat. No. 4,711,043 Johnson et al. It has the advantage over D'Amico of being usable during play. For the young player it has the disadvantage of utilizing a relatively complex method of attaching to their shoes. Also, because it is designed to only be attached over the laces, it cannot be used to teach the most accurate "push" pass or the deceptive "outside of the foot" pass.

OBJECTS AND ADVANTAGES

It is an object of the present invention to provide a soccer training device that can quickly and easily teach the new, young player to perform the important "shoelace kick".

Several additional objects and advantages of the present invention are:

(a) to provide a visual target on the foot that indicates from where to strike the ball;

(b) to provide an acoustic signal to indicate that the ball was kicked properly;

(c) to provide a kick teaching device that can be easily attached to the player's shoe;

(d) to provide a kick teaching device that does not hinder the player's movement;

(e) to provide a training device that can be used in practice games and drills;

(f) to provide a training device that is comfortable to wear and use; and (g) to provide a training device that is simple to manufacture, durable, and inexpensive.

Further objects and advantages of my invention will become apparent from a consideration of the drawings and ensuing description of it.

DETAILED DESCRIPTION

Figure 1:
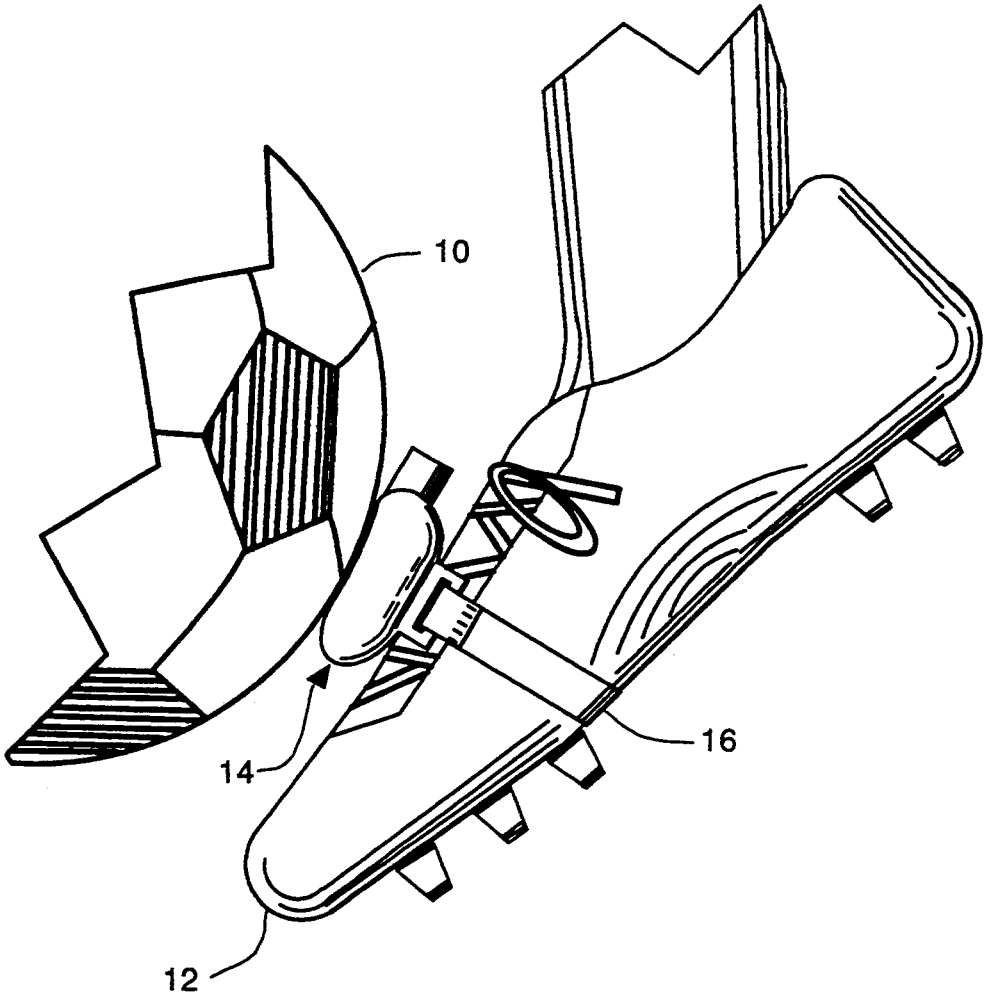
FIG. 1 is a side view of the first embodiment of the training device shown attached to a soccer player's shoe.

FIG. 1 illustrates the preferred embodiment of the invention 14 attached to a player's shoe 12 as a soccer ball 10 is being kicked.

Figure 2:
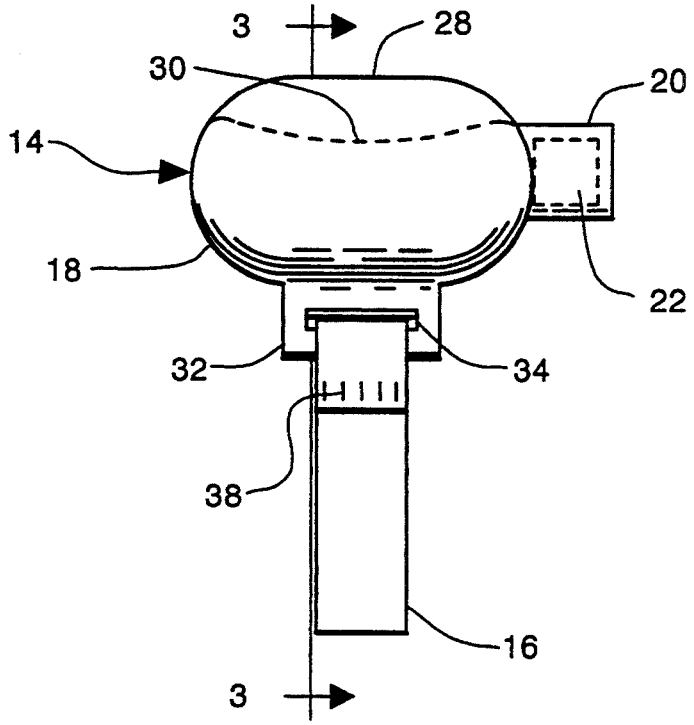
FIG. 2 is an enlarged side view of the first embodiment.
Figure 3:
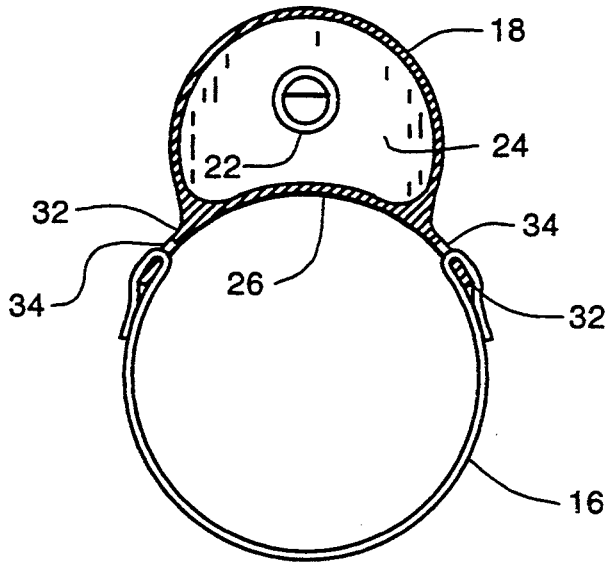
FIG. 3 is a cross-sectional view of the first embodiment taken along the cross-section line in FIG. 2.

Referring to FIG. 2 and FIG. 3, the assembly 14 includes a bulb 18 preferably formed of a molded generally soft resilient plastic material. The uppermost surface of bulb 18, is shown in a normal position 28, and at a depressed position 30. Said bulb 18 having a generally hollow interior 24. A generally hollow cylinder 20 projects from one end of the bulb 18. A reed whistle 22 is mounted inside of cylinder 20. A bottom side 26 is curved to form an arch to fit the top of player's shoe 12. The bottom continues beyond the bulb 18 to form extensions 32. Extensions 32 help to stabilize the position of the training aid 14, by widening the contact area 26 with the shoe 12. Slots 34 in the extensions 32 provide attachment holes for elastic strap 16. The strap 16 is looped through slots 34 and sewn together 38.

Figure 4:
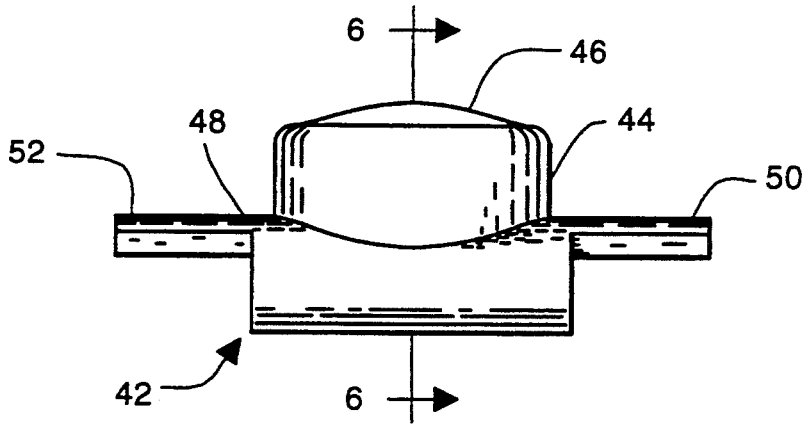
FIG. 4 is a side view of a second embodiment of the training device.
Figure 5:
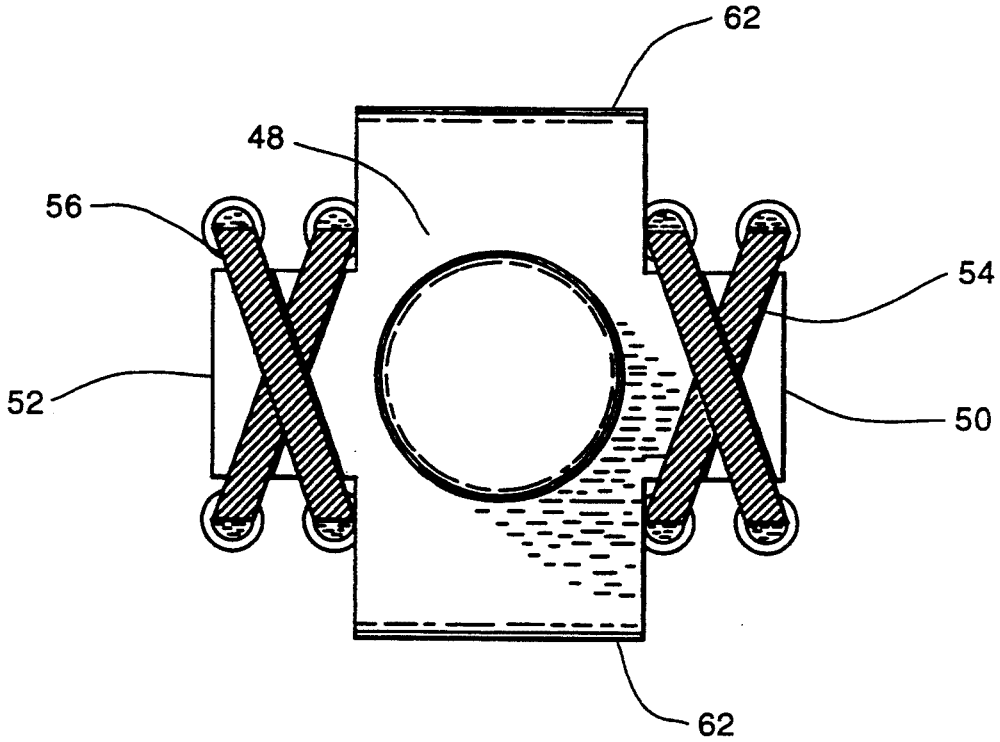
FIG. 5 is a top view of the second embodiment shown secured to a shoe by the laces.
Figure 6:
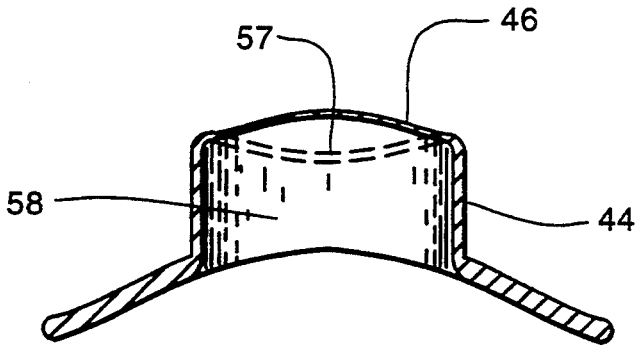
FIG. 6 is a cross-sectional view of the second embodiment taken along the cross-section line in FIG. 4.
Figure 7:
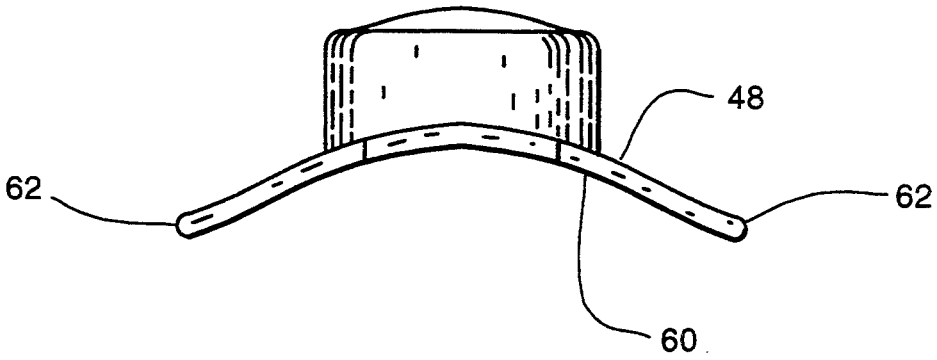
FIG. 7 is a front view of the second embodiment.

A side view of an alternate embodiment 42 is shown in FIG. 4. This embodiment would be preferably molded from a flexible, but generally more rigid, plastic than the preferred embodiment 14. Referring to FIGS. 4, 5 and 6, a cylinder 44 is enclosed at one end 46. Closed end 46 is a thin walled flexible dome which can be depressed to a position generally shown as 57. Cylinder 44 has a generally hollow interior 58. Cylinder 44 is attached to base 48. As shown in FIG. 7, base 48 is formed into an arch 60 to generally fit the contour of the top of a soccer shoe 12 near the laces. Extensions 62 help to stabilize the position of the training aid 42 by widening the contact area 60 with the shoe 12. Tongues 50 and 52 extend from base 48 to form front and rear shoelace attachments, best seen in FIG. 5. Laces are shown as 54 and 56.

OPERATION

The first embodiment 14 of the soccer training device of this invention attaches to player's shoe 12 by elastic strap 16. The strap 16 is expanded to allow the player to slip the device over the laces and cleats. The elasticity of the strap 16 is sufficient to hold the training device in place during repeated kicks of the soccer ball.

When a soccer ball 10 is kicked, the bulb 18 is compressed. The uppermost surface 28 of the bulb 18 is depressed to a position approximately shown as 30. Compression of the bulb, forces air out through the weed whistle 22. The air passing through the whistle 22 creates a sound that can readily heard by the soccer player and his or her coach. The sound indicates that the player has accomplished a proper "top of the laces" kick. As the ball departs, the uppermost surface of the bulb returns from its depressed position 30, to its normal position 28.

Operation of the second embodiment can be best shown from FIGS. 5 and 6. The second embodiment is attached to the player's shoe by the shoe laces 54 and 56. The laces are untied and loosened so that tongue 52 can be slipped under laces 56. Laces 54 are then pulled over attachment 50. The shoe laces are then tightened up and retied. The second embodiment indicates a proper "top of the laces" kick by a popping sound. This popping sound is created when the uppermost surface is forced, by the ball, from its normal dome shape 46, to its depressed position 57. When the ball departs, another pop occurs when the surface snaps back to its original position 46. Cylinder 44 and base 48 act as sound resonators. Both popping sounds are then easily heard by the player and the coach.

A strong, accurate, kicking ability is the most important skill required for playing soccer. Power and accuracy come from kicking the ball with the top of the foot, over the laces. Without the use of the present invention, it is difficult to teach young players this skill. With this training aid and a little instruction, the new players are able to teach themselves. The device also does not hamper their movement, so it can be used during drills and scrimmages. Thus, they can learn to kick the ball properly under game like conditions. It can also be used with other training aids, like the ones previously described.

Although the description above contains many specificities, these should not be construed as limiting the scope of the invention but as merely providing illustrations of some of the presently preferred embodiments of this invention. Thus the scope of the invention should be determined by the appended claims and their legal equivalents, rather than by the examples given.

I claim:

1. A soccer training and practice device comprising:

(a) a resilient generally hollow bulb with an opening, (b) an air activated acoustic indicator coupled to said opening, (c) the bottom surface of said bulb being a flexible arch (26) so as to conform to the curves of a players shoe adjacent the laces, (d) the bottom continuing beyond the bulb to form extensions (32) of said arch serve to stabilize said device on players shoe, (e) an elastic strap connected to said extensions for attaching said device around a players shoe, whereby said device can be easily attached and adjusted to several positions on a players shoe.

2. A soccer training and practice device comprising:

(a) a resilient domed shaped mechanical acoustic indicator, and (b) an acoustic resonator means attached to said acoustic indicator, (c) said resonator means mounted on a base, (d) the bottom surface of said base forming an arch (60) that generally conforms to the curve of a players shoe adjacent the laces, (e) extensions (62) to provide a wider contact area to stabilize said device the on a players shoe, (f) a tongue (52) extends forward from said base for mounting said device under the shoe laces near the toe of a shoe, (g) a tongue (50) extends backward from said base for mounting said device under the shoe laces near the shoe lace knot.

* * * * *